US008316468B2

(12) United States Patent
Skottheim et al.

(10) Patent No.: US 8,316,468 B2
(45) Date of Patent: Nov. 27, 2012

(54) HOCKEY PANT WITH REMOVABLE OUTER SHELL

(75) Inventors: Leif Skottheim, Malung (SE); Keith Leach, Foxborough, MA (US); Alain Castonguay, Blainville (CA); Pierre Paiement, St-Jerome (CA)

(73) Assignee: Sport Maska Inc., Montreal, Quebec (CA)

( * ) Notice: Subject to any disclaimer, the term of this patent is extended or adjusted under 35 U.S.C. 154(b) by 387 days.

(21) Appl. No.: 11/580,189

(22) Filed: Oct. 13, 2006

(65) Prior Publication Data

US 2007/0101474 A1 May 10, 2007

Related U.S. Application Data

(60) Provisional application No. 60/726,189, filed on Oct. 14, 2005.

(51) Int. Cl.
*A41D 13/00* (2006.01)

(52) U.S. Cl. ..... 2/227

(58) Field of Classification Search ..... 2/79, 227, 2/220, 235–237, 223, 238, 400, 403, 401, 2/406, 464, 465, 44
See application file for complete search history.

(56) References Cited

U.S. PATENT DOCUMENTS

| | | | | |
|---|---|---|---|---|
| 1,803,335 | A | | 5/1931 | Levinson |
| 1,805,734 | A | | 5/1931 | Jones |
| 1,915,754 | A | | 6/1933 | Shea |
| 3,170,163 | A | | 2/1965 | Mitchell |
| 3,484,868 | A | | 12/1969 | Davenport |
| 3,594,817 | A | | 7/1971 | Kelly |
| 3,771,171 | A | | 11/1973 | Mitchell |
| 4,325,148 | A | | 4/1982 | Livernois |
| D268,142 | S | | 3/1983 | Livernois |
| 4,479,269 | A | | 10/1984 | Balliet |
| 4,700,407 | A | | 10/1987 | Mattila |
| 4,807,301 | A | | 2/1989 | Ferber |
| 4,811,427 | A | | 3/1989 | Regan et al. |
| 5,050,244 | A | * | 9/1991 | Kleinman ..... 2/227 |
| 5,105,473 | A | | 4/1992 | Valtakari |
| 5,134,726 | A | | 8/1992 | Ross |
| 5,161,257 | A | | 11/1992 | Arensdorf et al. |
| D343,496 | S | | 1/1994 | Spoor et al. |
| D346,891 | S | | 5/1994 | Yee |
| D348,973 | S | | 7/1994 | Stewart et al. |
| 5,497,511 | A | * | 3/1996 | Zade ..... 2/22 |
| 5,539,927 | A | | 7/1996 | Holubec |
| 5,551,082 | A | | 9/1996 | Stewart et al. |
| 5,584,072 | A | | 12/1996 | Kim et al. |
| D378,469 | S | | 3/1997 | Tremblay |
| 5,608,915 | A | | 3/1997 | Libit |
| D387,539 | S | | 12/1997 | Wagner |

(Continued)

FOREIGN PATENT DOCUMENTS

CA 2076131 A1 2/1994

(Continued)

*Primary Examiner* — Tejash Patel
(74) *Attorney, Agent, or Firm* — Birch, Stewart, Kolasch & Birch, LLP

(57) ABSTRACT

A protective pant comprising an inner pant including at least one first protective member, and an outer pant independent from the inner pant, the outer pant including at least one second protective member and a retaining element for retaining the out pant in place around the inner pant, the first and second protective members cooperating to protect at least one body portion of a wearer.

27 Claims, 6 Drawing Sheets

U.S. PATENT DOCUMENTS

| | | | | |
|---|---|---|---|---|
| D392,437 | S | 3/1998 | Duval | |
| 5,918,310 | A | 7/1999 | Farahany | |
| 5,926,856 | A * | 7/1999 | Duval | 2/455 |
| 5,966,739 | A | 10/1999 | Wagner | |
| 6,023,789 | A | 2/2000 | Wilson et al. | |
| 6,070,273 | A | 6/2000 | Sgro | |
| 6,317,893 | B1 * | 11/2001 | Walton | 2/227 |
| 6,532,599 | B1 | 3/2003 | Dugan | |
| 6,637,036 | B2 | 10/2003 | Béland | |
| 6,701,533 | B2 | 3/2004 | Webb | |
| 6,782,559 | B2 | 8/2004 | Regan et al. | |
| 6,804,832 | B2 * | 10/2004 | Beland | 2/227 |
| 7,058,987 | B2 * | 6/2006 | Salazar | 2/247 |
| 7,237,270 | B2 | 7/2007 | Crye et al. | |
| 2002/0042944 | A1 | 4/2002 | Beland | |
| 2002/0178483 | A1 | 12/2002 | Beland | |
| 2003/0051288 | A1 | 3/2003 | Dugan | |
| 2003/0056275 | A1 | 3/2003 | Regan | |
| 2003/0093852 | A1 | 5/2003 | Webb | |
| 2004/0116260 | A1 | 6/2004 | Drennan | |
| 2006/0282938 | A1 | 12/2006 | Jewell et al. | |

FOREIGN PATENT DOCUMENTS

| | | | |
|---|---|---|---|
| CA | 2130644 | A1 | 7/1996 |

* cited by examiner

HOCKEY PANT WITH REMOVABLE OUTER SHELL

CROSS-REFERENCE TO RELATED APPLICATIONS

The present application claims priority on provisional U.S. patent application No. 60/726,189 filed Oct. 14, 2005, which is incorporated by reference herein in its entirety.

BACKGROUND OF THE INVENTION

1. Field of the Invention

The present invention relates to sports protective equipment, particularly to such equipment to be used in the game of hockey, for example, ice hockey, street hockey, in-line skate hockey and so on.

2. Brief Discussion of the Background Art

Hockey is a contact sport, and as such, players must be protected against impact, either from other players, from the boards, or from falls on the ice, pavement, etc. In order to protect the mid-portion of a player's body, the region which roughly comprises the area from above the knees to the mid-back portion, and which covers the front, back and lateral sides, players have traditionally worn hockey pants. Hockey pants have traditionally been slipped on over other equipment, such as, for example, athletic protector, shin guards, socks and even sometimes skates.

Traditional hockey pants are generally made of strong nylon construction, and completely cover the mid portion of the player. Such pants are usually in the general form of an oversized pair of shorts. Traditionally, hockey pants are of unitary construction, i.e. they comprise all of the protective elements, padding and support structures in one piece of equipment. All of these elements are typically sewn together such that they cannot be taken apart, separated, removed or relatively adjusted. This is also true for the outer shell of the pant, i.e. the outermost layer of the pant.

This unitary hockey pant construction has some disadvantages. In particular, the outer shell, i.e. that part of the pant which is in contact with other players, the ice, the board, etc., frequently gets dirty and may require cleaning, repair or replacement. In addition, teams, especially high caliber or high performance teams, may wish to change the outer look, color and appearance of the hockey pants for home and away games, which with unitary construction hockey pants necessitates an additional complete hockey pant to be purchased and worn by the player. This is both costly and impractical.

In addition, players, coaches and trainers may wish to change the level of protection which is provided by the hockey pant, through either adding or removing padding and protection. At present, the known hockey pants do not readily allow the addition, removal or repositioning of protection, padding, etc. on the pants.

Accordingly, improvements are desirable.

SUMMARY OF THE INVENTION

It is therefore an objective of the present invention to provide an improved hockey pant.

Therefore, in accordance with the present invention, there is provided a protective pant comprising an inner pant including at least one first protective member, and an outer pant independent from the inner pant, the outer pant including at least one second protective member and a retaining element for retaining the outer pant in place around the inner pant, the first and second protective members cooperating to protect at least one body portion of a wearer.

Also in accordance with the present invention, there is provided an outer shell in combination with an inner pant including at least one first protective member, the outer shell comprising a torso portion and two tubular leg portions extending therefrom in communication therewith, a retaining element retaining the outer shell in place over the inner pant and independently therefrom, and at least one padding element removably retained on the outer shell for protecting a selected body portion of a wearer of the inner pant.

Further in accordance with the present invention, there is provided a kit comprising an outer shell for covering an inner sports pant, the outer shell including a torso portion adapted to cover a lower torso of a wearer, two tubular portions extending from the torso portion in communication therewith to each receive an upper leg of the wearer, and a retaining element for retaining the outer shell in place around the lower torso of the wearer, and a plurality of padding elements removably connectable to the outer shell, the plurality of padding elements including at least one of padding elements of different shapes and padding elements of different levels of protection.

As may be understood, "outer shell" will in the present application designate generally the outer most layer or covering of a hockey pant, i.e. that part of the hockey player equipment which protects the player's mid-section, e.g. from the region above the knees to approximately the mid-abdomen or possibly higher.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will come apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invent on and in which.

DETAILED DESCRIPTION OF PARTICULAR EMBODIMENTS

Figure 1:
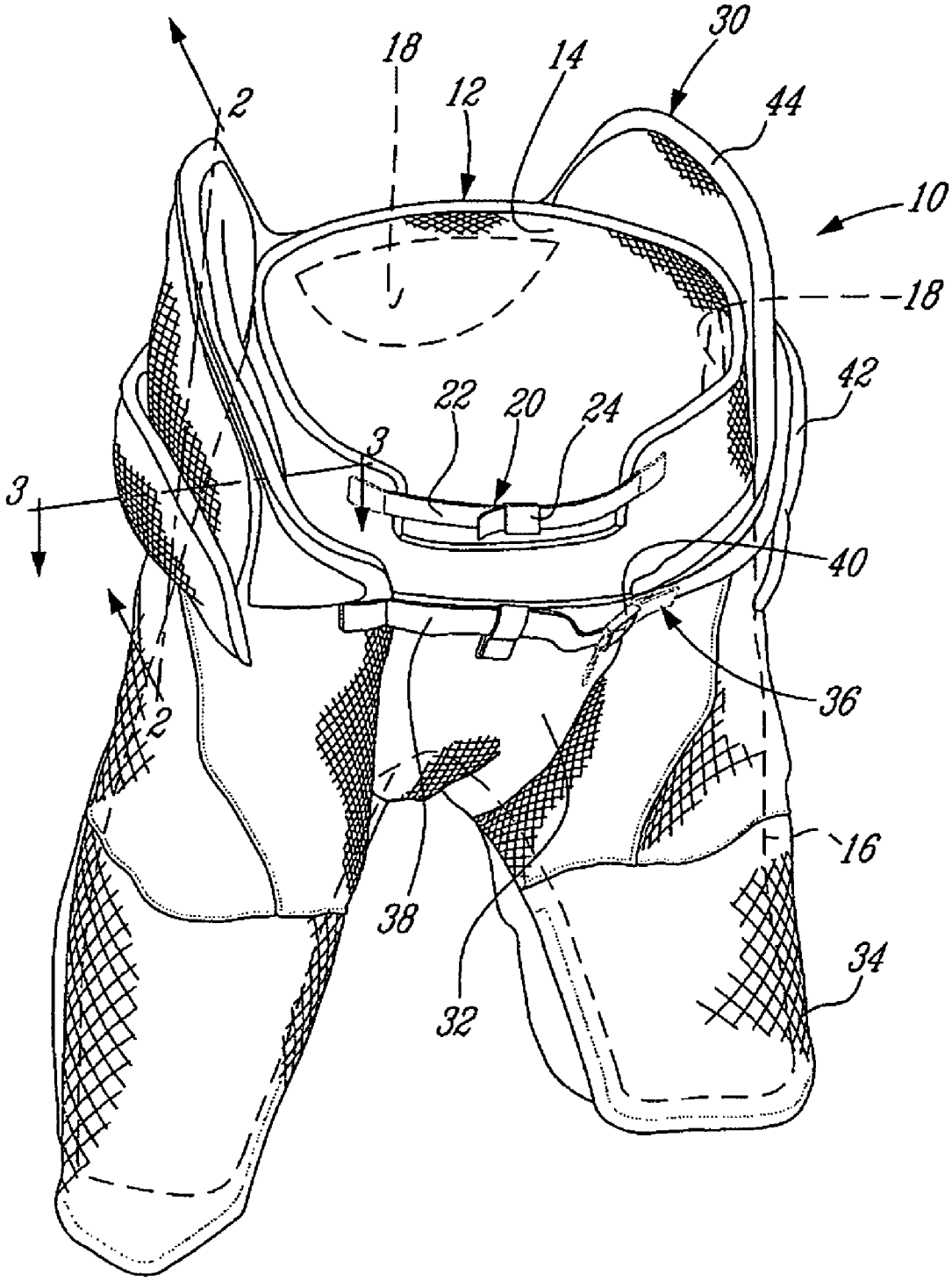
FIG. 1 is a perspective view of a hockey pant according to a particular embodiment of the present invention.

Referring to FIG. 1, a hockey pant according to a particular embodiment of the present invention is generally shown at 10.

The hockey pant 10 includes an inner pant or core protector 12 which generally comprises a torso portion 14 adapted to cover the lower torso of the wearer, and two leg portions 16 extending from the torso portion 14 in communication therefrom to each receive a leg of the wearer. The core protector 12 also includes padding or protective members 18 in a selected configuration. The padding members 18 may include, for example, padding members covering the lower back, thighs, hips and/or sides of the wearer.

The core protector 12 further includes at least one retaining element 20 for staying in position around the waist of the wearer, so that it does not fall down during play or use. Although the retaining element 20 is shown as including a strap 22 received and removably retained in a buckle 24, other types of retaining elements can alternately be used, such as for example a drawstring, Velcro® strips, zippers, buttons, snaps, or combinations thereof.

In a particular embodiment, the core protector 12 is similar to one of the core protectors described in simultaneously filed co-pending patent application entitled "CORE PROTECTOR WITH ADJUSTABLE THIGH PROTECTORS" (claiming priority on U.S. patent application No. 60/726,190 filed Oct. 14, 2005), which is incorporated herein by reference.

The hockey pant 10 further includes an outer shell 30 which generally acts as a protective or covering liner covering and protecting the core protector 12. The outer shell 30 thus comprises a torso portion 32 and two leg portions 34 extending therefrom in communication therewith. In a particular embodiment, the outer shell 30 is configured and cooperates with the core protector 12 so that the hockey pant 10 looks similar to known hockey pants of unitary construction.

The outer shell 30 is made of any appropriate type of material, such as for example nylon, Lycra, mesh materials, and any other additional adequate materials and/or combination thereof. In addition, various colors, logos and patterns may be utilized in order to achieve a particular visual effect. In a particular embodiment, the material used in the construction of the outer shell 30 includes water repelling characteristics so as to reduce or eliminate the absorption of water by the outer shell 30 when the wearer falls on the ice.

The outer shell 30 is sized and configured to be sufficiently large to easily or comfortably fit over the core protector 12. As may be understood, a player will, as he/she is getting dressed prior to a game or a practice, slip on various pieces of equipment, and at a certain point slip on the core protector 12. Either immediately afterwards or sometime thereafter, the outer shell 30 is slipped on over the core protector 12 so as to cover same. The core protector 12 and outer shell 30 can alternately be simultaneously slipped on.

In the embodiment shown, the outer shell 30 is not affixed to the core protector 12 but is simply disposed thereover, and therefore is allowed to float, i.e. to move independently therefrom. It is understood that the outer shell 30 does not necessarily move substantially in relation to the core protector 12, but that there may simply be some small, relative movement therebetween as a result of the motions of the wearer.

The outer shell 30, separate from the core protector 12, also includes a retaining element 36 for staying in position around the waist of the wearer. In the embodiment shown, the retaining element 36 retains the outer shell 30 on the wearer's body independently of the core protector 12, and includes a strap 38 removably engaged in a buckle 40. Alternate types of retaining elements 36 can also be used, such as for example a drawstring, Velcro® strips, zippers, buttons, snaps, or combinations thereof.

In an alternative embodiment, at least one retaining element, whether the previously described retaining elements 20, 36 themselves or separate/independent retaining elements, attaches the outer shell 30 to the core protector 12 in a removable fashion. Such retaining element(s) can include, for example, Velcro® strips, zipper(s), button(s), press fit button (s), snap(s), lace(s), or any combination thereof. For example, a zipper portion may be disposed along an outside perimeter of the core protector 12 to engage a corresponding zipper portion disposed on an inside perimeter of the outer shell 30 so as to keep the outer shell 30 in a fixed position with respect to the core protector 12. The outer shell 30 and core protector 12 may thus be detachably interconnected to allow a restrained relative movement therebetween, or alternately to completely prevent such relative movement.

Referring again to FIG. 1, the outer shell 30 includes hip protective members 42 which are disposed such as to protect the hips of the wearer, and side protective members 44 which extend to cover a side portion of the waist of the wearer up to, and preferably including, the lower ribs.

Figure 2:
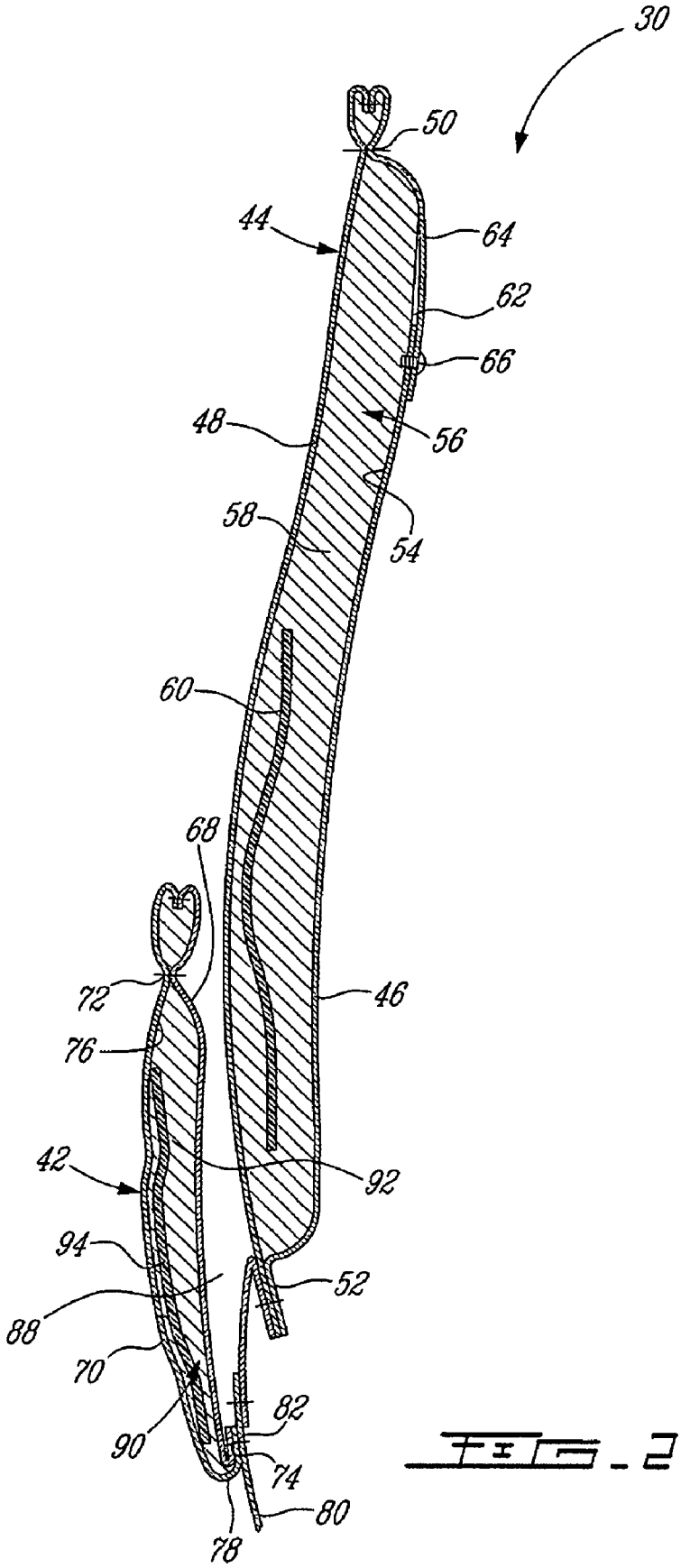
FIG. 2 is a vertical cross-sectional view of a portion of an outer shell of the pant of FIG. 1, taken along lines 2-2 thereof.

The side protective members 44 extend upwardly from a remainder of the outer shell 30. Referring to FIG. 2, each side protective member 44 comprises inner and outer fabric layers 46, 48, which are interconnected by spaced apart upper stitch line 50 and lower stitch line 52. The inner and outer layers 46, 48 define a pocket 54 therebetween, which is bound by the upper and lower stitch lines 50, 52. A side padding element 56 is received within the pocket 54 and maintained in place thereby. The side padding element 56 shown includes a foam pad 58 surrounding an insert 60 which is more rigid than the foam pad 58 and has a concave shape, i.e. with a center portion curving away from the wearer. In a particular embodiment, the insert 60 is made of thermosetting plastic.

In the embodiment shown, the side protective member 44 includes an opening 62 which is defined in the inner fabric layer 46, and a flap 64 (not depicted in FIG. 1) attached to or integral with the inner fabric layer 46 to selectively close the opening 62. The flap 64 is maintained in the closed position by a detachable fastener 66, such as for example a button or snap. With the fastener 66 detached, the flap 64 can be moved in an open position such as to gain access to the opening 62, and remove the side padding element 56 therethrough if so desired.

Alternately, the detachable fastener 66 can include a zipper, a lace, Velcro® strips, etc. closing or replacing the flap 64.

Still referring to FIG. 2, each hip protective member 42 comprises inner and outer fabric layers 68, 70, which are interconnected by spaced apart upper and lower stitch lines 72, 74 such as to define a pocket 76. The pocket 76 is connected adjacent a bottom edge 78 thereof by first attachment members 82 to a fabric layer 80 of the outer shell 30 extending downwardly from the side protective members 44.

Figure 3:
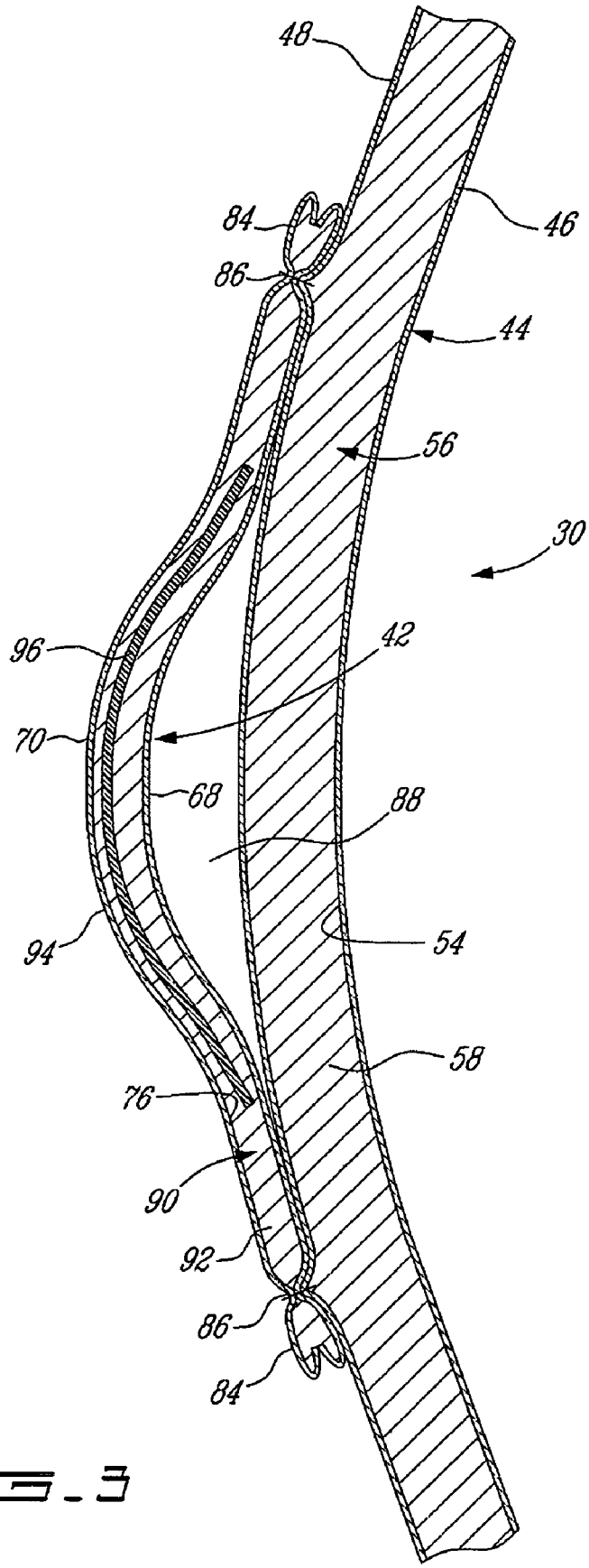
FIG. 3 is a horizontal cross-sectional view a portion of the outer shell of the pant of FIG. 1, taken along lines 3-3 thereof.

Referring to FIG. 3, the pocket 76 is also connected adjacent side edges 84 thereof to the outer fabric layer 48 of the respective side protective member 44 by second attachment members 86. As such, a gap 88 is defined between the hip protective member 42 and the remainder of the outer shell 30.

In the embodiment shown, the first and second attachment members 82, 86 include stitch lines and as such secure the hip protective member 42 to the outer shell 30 in a permanent fashion. Alternate permanent attachment members 82, 86 may include, for example, rivets or staples.

In an alternate embodiment, the first and second attachment members 82, 86 secure the hip protective member 42 to the outer shell 30 in a temporary or detachable fashion. In this case the attachment members 82, 86 can be, for example zippers, Velcro®, buttons, snap fit attachments, etc. As such the entire hip protective member 42 can be removed from the outer shell 30 if desired.

Referring to FIGS. 2-3, the hip protective member 42 includes a hip padding element 90 received within the pocket 76. The hip padding element 90 shown includes a foam pad 92 surrounding a more rigid insert 94 having a concave shape, i.e. with a center portion curving away from the wearer. In a particular embodiment, the insert 94 is made of thermosetting plastic.

Alternately, the padding element 56, 90 of one or both the hip and side protective members 42, 44 may include any other type of padding material suitable for sports equipment and other such protection, such as for example low density foam, high density foam, thermoplastics, composite materials or any combination thereof, and/or may have any other adequate shape adapted to the body portion to be protected. The inserts 60, 94 may also be omitted.

Figure 4:
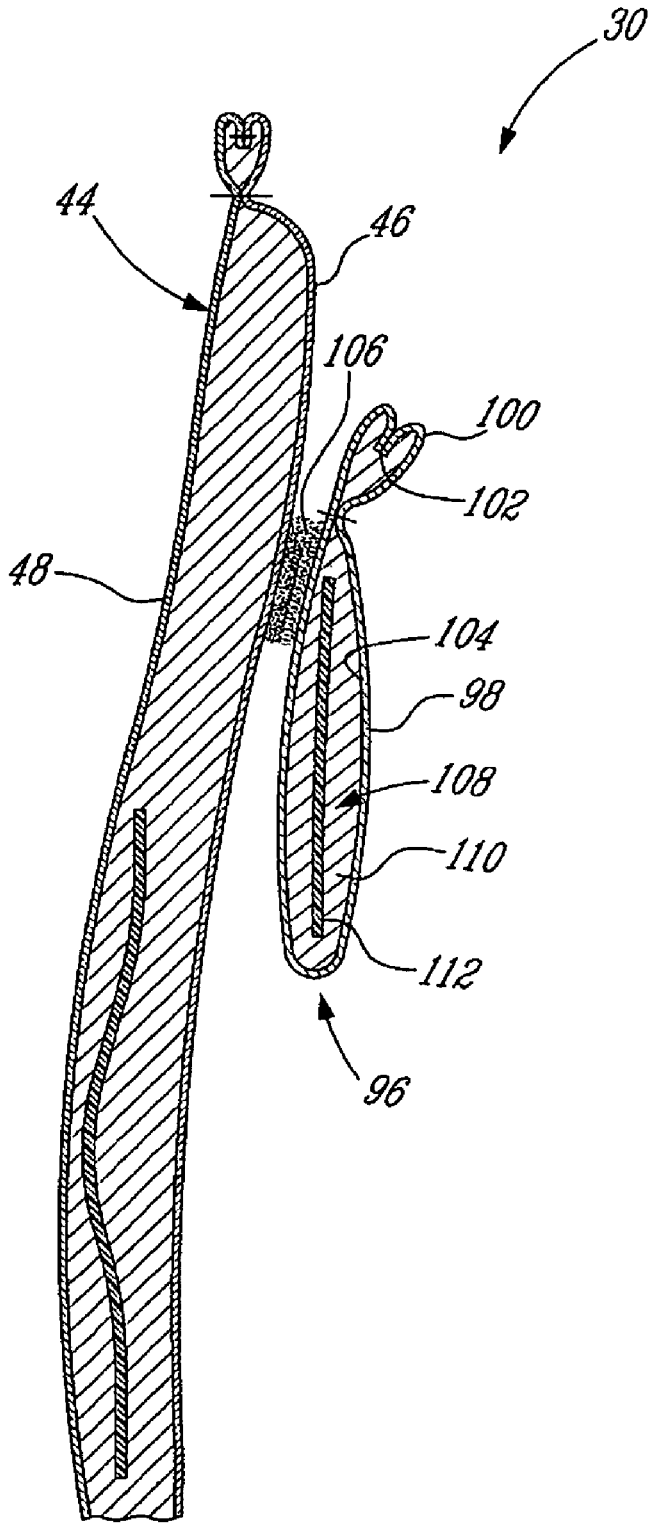
FIG. 4 is a vertical cross-sectional view of a portion of an outer shell according to an alternate embodiment of the present invention, showing an additional protective member which can replace the protective members shown in FIG. 1 or be used in combination therewith.

Referring to FIG. 4, in a particular embodiment, the outer shell 30 also includes an additional side protective member 96 (not shown in FIGS. 1-3) attached to the side protective member 44. The additional side protective member 96 includes a fabric layer 98 which is folded and attached along a top edge 100 thereof, for example by a stitch line 102, such as to define a pocket 104. Alternately, the pocket 104 can be formed by two fabric layer interconnected along opposed edges thereof.

The pocket 104 is attached adjacent the top edge 100 to the inner fabric layer 46 of the side protective member 44 by one or more attachment members 106. Alternately, the pocket 104 may be attached to any other appropriate fabric layer of the outer shell 30.

In the embodiment shown, the attachment members 106 include Velcro® strips such that the pocket 104 can be removed from the outer shell 30 if desired. Alternate attachment members 106 include other temporary attachment members, e.g. a zipper, buttons, and snap fit attachments, as well as permanent attachment members, e.g. stitches, rivets, and staples.

The pocket 104 receives and encloses an additional side padding element 108, which in the embodiment shown includes a foam pad 110 surrounding a more rigid insert 112 preferably made of thermosetting plastic. As for the previously described padding elements 56, 90, the additional side padding element 108 may alternately include any other type of padding material suitable for sports equipment and other such protection, such as for example low density foam, high density foam, thermoplastics, composite materials or any combination thereof, and/or may have any adequate other shape adapted to the body portion to be protected. The insert 112 may also be omitted.

Although not shown, the pocket 104 can also include an opening defined therein selectively closable by a closing member as described in previous embodiments, such as to be able to remove the additional side padding element 108 therefrom. This is particularly useful in the embodiment where the pocket 104 is permanently attached to the outer shell 30.

Figure 5:
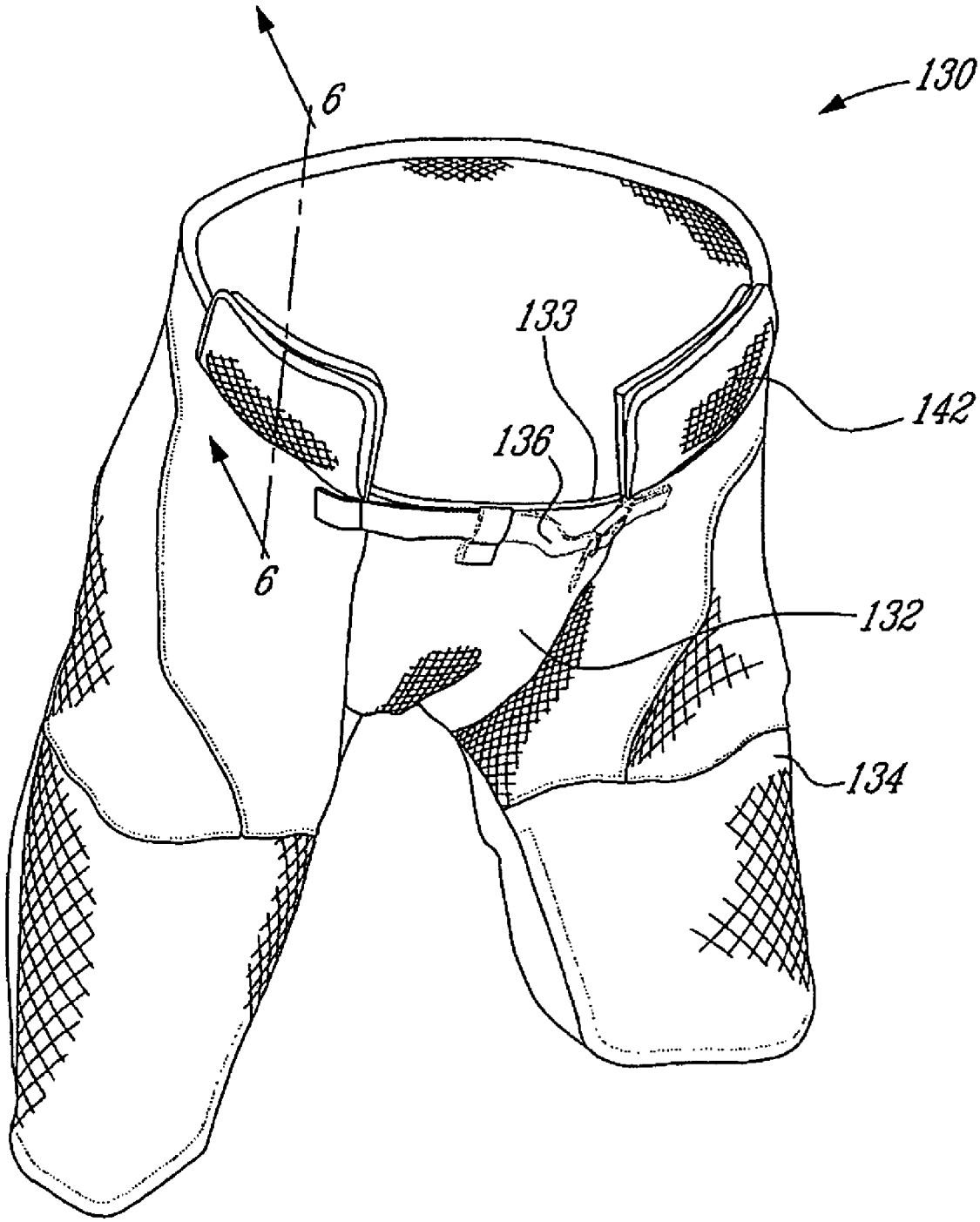
FIG. 5 is a perspective view of an outer shell for a hockey pant according to an alternate embodiment of the present invention.

Referring to FIG. 5, an outer shell 130 according to an alternative embodiment of the present invention is shown. The outer shell 130, similarly to the previously described outer shell 30, includes a torso portion 132 and leg portions 134 extending therefrom, as well as a retaining element 136 for retaining the outer shell 130 around the waist of the wearer. The outer shell 130 further includes front hip protective members 142 which extend generally above an upper circumferential edge 133 of the remainder of the outer shell 130 such as to cover the crest of the ilium of the hip bone of the wearer.

Figure 6:
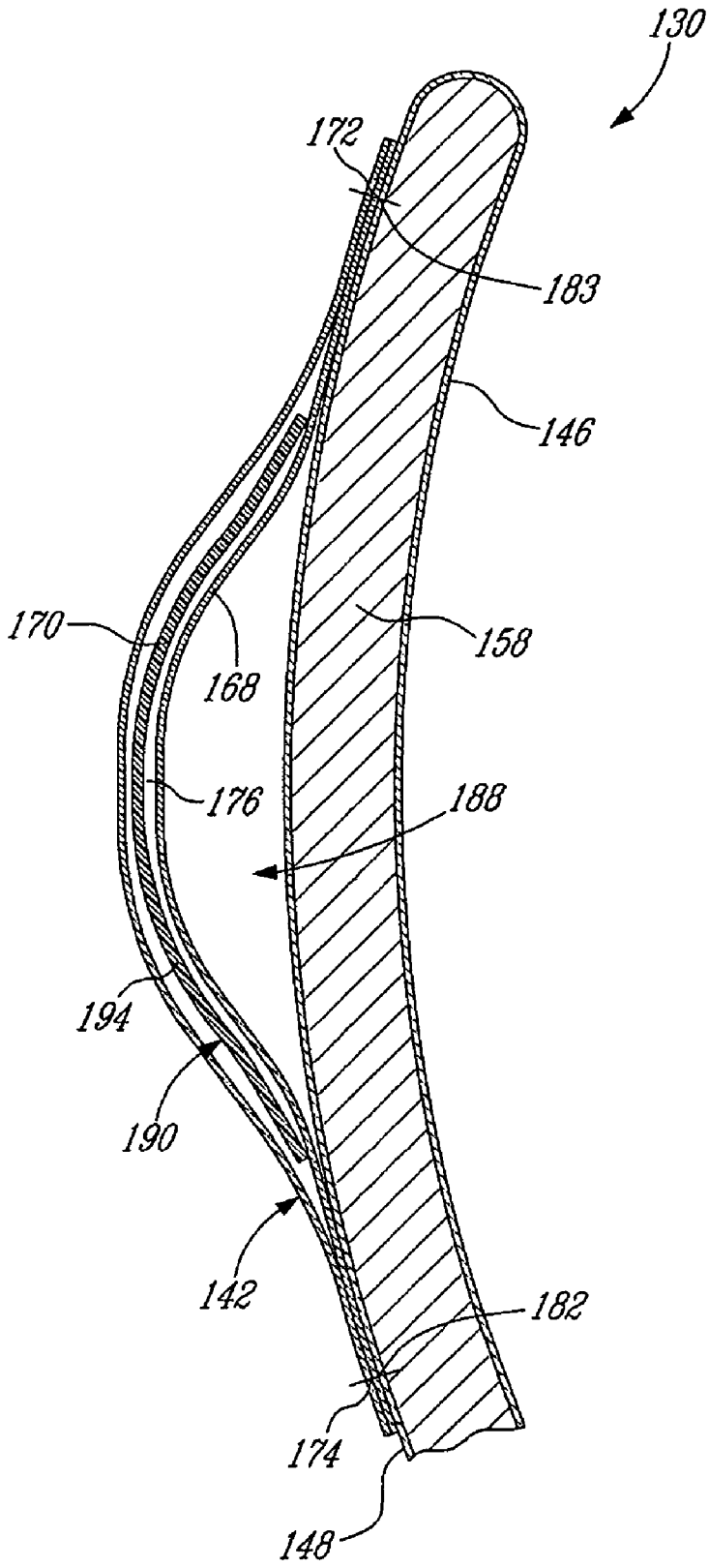
FIG. 6 is a vertical cross-sectional view of a portion of the outer shell of FIG. 5, taken along lines 6-6 thereof.

Referring to FIG. 6, the outer shell includes inner and outer interconnected fabric layers 146, 148, and a foam pad 158 extending therebetween. Alternately, the foam pad 158 can be omitted, and the inner and outer fabric layers 146, 148 can be replaced by a single fabric layer. The fabric layers 146, 148 extend above the upper circumferential edge 133 behind the front hip protective members 142.

Each front hip protective member 142 includes inner and outer fabric layer 168, 170 which are interconnected by vertically spaced apart upper and lower stitch lines 172, 174 such as to define a pocket 176 therebetween. The pocket 154 is attached to the outer fabric layer 148 of the outer shell 130 through vertically spaced apart attachment members 182, 183, thus defining a gap 188 between the pocket 176 and the outer layer 148 of the outer shell 130. In the embodiment shown, the attachment members 182, 183 include the stitch lines 172, 174 defining the pocket 176. As above, alternate attachment members include other permanent attachment members such as rivets or additional stitches, or temporary attachment members, e.g. zippers, Velcro®, buttons, and snap fit attachments.

The front hip protective member 142 includes a front hip padding element 190 received in the pocket 176, which in the embodiment shown is composed of a substantially rigid or rigid insert 194, preferably made of thermosetting plastic. As for the previously described padding elements 56, 90, 108, the front hip padding element 190 may additionally include a foam pad, and/or alternately include any other type of padding material suitable for sports equipment and other such protection, such as for example low density foam, high density foam, thermoplastics, composite materials or any combination thereof, in replacement of or in combination with the insert 194.

The hockey pant 10 described herein, and particularly the outer shell 30, 130 presents several advantages. The independent outer shell 30, 130, i.e. separate or detachably connected to the core protector 12, allows a wearer to change the outer appearance and protection provided by the hockey pant 10 by simply changing the outer shell 30, 130 while keeping the same core protector 12. In addition, the hockey pant 10 can be more easily washed and repaired since the portion of the pant 10 which is more exposed to damage and dirt, i.e. the outer shell 30, 130, is readily removable from the rest of the pant 10.

In addition, the use of pockets 54, 76, 104, 176 which are removable and/or selectively openable allow the selective removal of the padding elements 56, 90, 108, 190 and/or of the protective members 42, 44, 96, 142 from the outer shell 30, 130 in order to allow the shell 30, 130 to be washed, repaired, or reconfigured to provide more or less padding elements 56, 90, 108, 190 and/or of the protective members 42, 44, 96, 142 in various portions of the outer shell 30, 130.

In a particular embodiment, at least some of the protective members 42, 44, 96, 142 and/or padding elements 56, 90, 108, 190 are removable from the outer shell 30, 130, and the outer shell 30, 130 is provided in a kit including additional padding elements and/or protective members which can be selectively attached to the outer shell 30, 130 by the wearer. The additional padding elements preferably have at least one of different shapes and different levels of protection, such that the wearer can customize the outer shell 30, 130. Padding elements of different levels of protection can for example be made of different materials and/or have different dimensions.

As such, the outer shell 30, 130 provides flexibility for selectively putting padding thereon. For example, the outer shell 30, 130 may be provided with a large number of pockets 54, 76, 104, 176 which the wearer can selectively attach to the outer shell 30, 130 and/or selectively fill with padding elements 56, 90, 108, 190, allowing the wearer to custom build the outer shell 30, 130 to provide a desired configuration and level of protection. The protection configuration and/or level can easily be changed, for example by adding/removing/changing one or more protective members 42, 44, 96, 142 and/or padding elements 56, 90, 108, 190, or by moving one or more protective members 42, 44, 96, 142 and/or padding elements 56, 90, 108, 190 to a different location on the outer shell 30, 130, or by varying the stiffness of the protective members 42, 44, 96, 142.

In an alternate embodiment not shown, the padding elements 56, 90, 108, 190 are directly attached to the outside or to the inside of the outer shell 30, 130 through the use of straps, Velcro, snap-fit buttons or any other attachment means as required or desired, i.e. without being received in a pocket of fabric.

The embodiments of the invention described above are intended to be exemplary. Those skilled in the art will therefore appreciate that the foregoing description is illustrative only, and that various alternatives and modifications can be devised without departing from the spirit of the present invention. For instance, elements from the various embodiments shown and described can be combined. The number of protective members on the outer shell can vary. The configuration and disposition of the protective member(s) on the outer shell can vary as well, and includes for example protective member (s) on or near the hips, the thighs, the waist, the tail bone, the back, the kidneys, etc., in either a symmetrical or asymmetrical distribution.

The present invention could also be applied in numerous other types of protection gear and should not be viewed as limited to hockey or even to sports. Accordingly, the present invention is intended to embrace all such alternatives, modifications and variances which fall within the scope of the appended claims.

The invention claimed is:

1. A protective pant comprising:

an inner pant including at least one first protective member providing impact protection; and an outer pant independent from the inner pant with leg portions of the inner and outer pant being free from each other, the outer pant including a retaining element for retaining the outer pant in place around the inner pant, the outer pant defining at least one pocket containing a second protective member therein, the first and second protective members cooperating to protect at least one body portion of a wearer, wherein the second protective member is a side protective member, and wherein an inner fabric layer and an outer fabric layer define the pocket.

2. The protective pant according to claim 1, wherein the at least one pocket is defined as being between adjacent fabric layers of the outer pant and the second protective member includes a padding element received within the at least one pocket.

3. The protective pant according to claim 1, wherein the second protective member is removable from the outer pant.

4. The protective pant according to claim 1, wherein the at least one pocket is openable and the second protective member includes a padding element removably received within the openable pocket.

5. The protective pant according to claim 1, wherein the at least one pocket is detachably connected to a fabric layer of the outer pant.

6. The protective pant according to claim 1, wherein the second protective member includes a substantially rigid insert.

7. The protective pant according to claim 1, wherein the second protective member extends above an upper circumferential edge of the outer pant.

8. The protective pant according to claim 1, wherein the second protective member includes at least a hip protective member.

9. An outer shell in combination with an inner pant, the inner pant including at least one first protective member providing impact protection, and the outer shell comprising:

a torso portion and two tubular leg portions extending therefrom in communication therewith, each tubular leg portion having a distal end spaced from the torso portion;

a retaining element retaining the outer shell in place over the inner pant and independently therefrom with the distal end of each tubular leg portion being unconnected to the inner pant; and at least one padding element removably retained in a second protective member on the outer shell for protecting a selected body portion of a wearer of the inner pant, wherein said second protective member is a side protective member in a pocket defined by an inner fabric layer and an outer fabric layer.

10. The combination according to claim 9, wherein the padding element is removably retained on the outer shell by being contained in the fabric pocket detachably connected to the outer shell.

11. The combination according to claim 9, wherein the padding element is removably retained on the outer shell by being removably contained in the fabric pocket defined between adjacent fabric layers of the outer shell.

12. The combination according to claim 9, wherein the padding element is removably retained on the outer shell by being removably contained in the fabric pocket connected to the outer shell.

13. The combination according to claim 9, wherein the padding element includes a substantially rigid insert.

14. The combination according to claim 13, wherein the padding element includes a foam pad surrounding the insert.

15. A kit comprising:

an inner sports pant;

an outer shell covering the inner sports pant, the outer shell including a torso portion adapted to cover a lower torso of a wearer, two tubular portions extending from the torso portion in communication therewith to each receive an upper leg of the wearer, the tubular portions being free of the inner sports pant, at least one side protective padding member and a retaining element for retaining the outer shell in place around the lower torso of the wearer; and a plurality of padding elements removably connectable to the outer shell, the plurality of padding elements including padding elements of different shapes or padding elements of different levels of protection.

16. The kit according to claim 15, wherein the outer shell includes a plurality of pockets defined therein or attached thereto, at least part of the pockets receiving a respective one of the padding elements therein.

17. The kit according to claim 16, wherein the pockets are detachably connected to the outer shell.

18. The kit according to claim 16, wherein each of the at least part of the pockets removably receives the respective padding element therein.

19. The kit according to claim 15, wherein the padding elements include a substantially rigid insert.

20. The kit according to claim 19, wherein the padding elements include a foam pad surrounding the insert.

21. The kit according to claim 15, wherein the plurality of padding elements includes padding elements of different sizes and different levels of protection.

22. The protective pant according to claim 1, wherein the retaining element is an outer retaining element, the inner pant including an inner retaining element separate from the outer retaining element for retaining the inner pant in place around a waist of the wearer.

23. The combination according to claim 9, wherein the retaining element is an outer retaining element, the inner pant including an inner retaining element separate from the outer retaining element for retaining the inner pant in place around a waist of the wearer.

24. The kit according to claim 15, wherein the retaining element is an outer retaining element, the inner sports pant including an inner retaining element separate from the outer retaining element for retaining the inner sports pant in place around the lower torso of the wearer.

25. The protective pant according to claim 1, wherein the outer pant is disposed over the inner pant without being attached thereto.

26. The combination according to claim 9, wherein the outer shell is disposed over the inner pant without being attached thereto.

27. The kit according to claim 15, wherein the outer shell is disposed over the inner sports pant without being attached thereto.

* * * * *